United States Patent [19]

Andreadakis

[11] Patent Number: 4,853,590

[45] Date of Patent: Aug. 1, 1989

[54] SUSPENDED-ELECTRODE PLASMA DISPLAY DEVICES

[75] Inventor: Nicholas C. Andreadakis, Readington Township, Hunterdon County, N.J.

[73] Assignee: Bell Communications Research, Inc., Livingston, N.J.

[21] Appl. No.: 226,801

[22] Filed: Aug. 1, 1988

[51] Int. Cl.[4] ..... H01J 17/49

[52] U.S. Cl. ..... 313/485; 313/491; 313/587

[58] Field of Search ..... 313/485, 491, 494, 586, 313/587

[56] References Cited

U.S. PATENT DOCUMENTS

| | | | |
|---|---|---|---|
| 3,704,052 | 11/1972 | Coleman | 313/586 X |
| 3,896,327 | 7/1975 | Schermerhorn | 313/586 X |
| 4,352,042 | 9/1982 | Lorenz et al. | 313/485 |

OTHER PUBLICATIONS

"Ion Bombardment Effect on Single Substrate Color Plasma Displays," Peter D. T. Ngo et al., Proc. 1987 IDRC, Euro-Display '87, London, pp. 123–126, Sep. 15–17, 1987.

"A Three-Electrode ac Plasma HVCMOS Drive Scheme," G. W. Dick et al., Proceedings 1/1986 SID Symposium, pp. 212–216.

"Color ac Plasma display with Emissive Dielectric Layer," P. D. T. Ngo et al., Proc. 1986 IDRC, Japan Display, 1/86, Tokyo, pp. 494–495.

"Green Surface Discharge Plasma Decode Displays, " T. Shinoda et al., Conf. Record, 1/1985 IDRC, San Diego, pp. 51–54.

"Phosphor Color Conversion with a Visible Discharge, Three Electrode, ac Plasma Display," G. W. Dick et al., Proc. 1986 IDRC, Japan Display 1/86, Tokyo, pp. 504–506.

"Thick Film Dielectrics as HF Acid Resists," N. C. Andreadakis et al., Proc. 1/1986 ISHM Conference, Atlanta, pp. 815–818.

"Characterization of Surface Discharge AC Plasma Display Panels," H. Uchiike et al., Proceedings 1/1987 SID Symposium, New Orleans, pp. 88–91.

"A Green ac Plasma Display," H. Yamashita et al., Dig. of Papers, 1/1976 SID Symposium, Beverly Hills, pp. 80–81.

"Color TV Display with AC-PDP," M. Yokozawa et al, Proc. 1983 IDRC, Japan Display 1/83, pp. 514–517.

"High Resolution Thick-film Dielectric Barriers for Optical Isolation in Color Plasma Displays," N. C. Andreadakis et al., IEEE Transactions on Electron Devices, vol. ED-33, No. 8, pp. 1180–1183, Aug. 1986.

"Three-Electrode Per Pel ac Plasma Display Panel," G. W. Dick, Conf. Record 1/1985 IDRC, San Diego, pp. 45–50.

*Primary Examiner*—Kenneth Wieder

*Attorney, Agent, or Firm*—James W. Falk

[57] ABSTRACT

A high-resolution flat-panel plasma display device made in solid-state form and designed for large-area full-color applications includes first and second sets of orthogonally disposed electrodes on a substrate to which a phosphor-containing faceplate is sealed. The electrodes of one set are respectively suspended relatively high above the substrate surface on spaced-apart longitudinally extending dielectric ridges.

14 Claims, 5 Drawing Sheets

SUSPENDED-ELECTRODE PLASMA DISPLAY DEVICES

BACKGROUND OF THE INVENTION

This invention relates to plasma display devices and, more particularly, to flat-panel plasma display devices made in solid-state form and designed for full-color applications.

A variety of color plasma display devices are known in the art. In one such device, an X-Y array of electrodes formed on a substrate is utilized to ionize selected pixel regions of a gas contained between the substrate and a mating faceplate. In turn, the ionized regions cause respectively associated luminescent areas on the faceplate to be excited to emit light of a particular color.

As the size and resolution of plasma display devices have increased, several deficiencies in their basic design as heretofore proposed have become apparent. For example, the thick-film screening techniques typically utilized to make such devices have been found to be not capable of achieving very dense arrays of high-resolution pixels. Moreover, as the design of these high-resolution devices has required their electrodes to be located closer and closer together, typically separated by only extremely thin layers of high-dielectric-constant glass, it has become evident that the relatively high inter-electrode capacitances of such a design constitute a major deterrent to the realization of large-area displays. This is so because these capacitances impose high current demands on associated electrical circuitry employed to drive the display. As display sizes increase, so too does the amount of required drive power, calling for ever more complex and expensive driver designs, to the point where the display may be no longer technically and/or economically feasible.

Accordingly, efforts have been directed by workers skilled in the art aimed at trying to improve the design of plasma display devices. In particular, these efforts have been directed at trying to achieve practicable designs for high-resolution large-area color display devices characterized by relatively low inter-electrode capacitances. It was recognized that these efforts, if successful, could contribute significantly to lowering the cost and improving the performance of such devices.

SUMMARY OF THE INVENTION

In accordance with the principles of the present invention, a high-resolution plasma display device made by photolithographic and other integrated-circuit fabrication techniques includes X- and Y-direction electrodes formed on a substrate in a manner that insures that the inter-electrode capacitance of the device is relatively low. In one embodiment of the present invention, pairs of so-called sustain electrodes are suspended above the surface of the substrate on respective longitudinally extending dielectric ridges that include spaces therebetween. The resulting relatively large separation between the suspended sustain electrodes and orthogonally disposed electrodes on the surface of the substrate causes the capacitance between the sustain electrodes and the surface electrodes to be relatively low. Additionally, the spaces between the sustain electrodes cause the capacitance between them also to be relatively low.

In another embodiment of the invention, the paired sustain electrodes are fabricated directly on the surface of the substrate and trenches are formed in the substrate between the electrodes of each pair. In that way, the capacitance between adjacent sustain electrodes on the substrate surface is made relatively low. Further, electrodes disposed orthogonally with respect to the sustain electrodes are suspended above the substrate surface on respective longitudinally extending dielectric ridges that include spaces therebetween. This insures both that the capacitance between adjacent suspended electrodes is relatively low and that the capacitance between the suspended electrodes and the sustain electrodes on the substrate surface is also relatively low.

In one specific illustrative embodiment of the invention, the electrodeless faceplate of the display device includes multiple spaced-apart photolithographically defined wells each having a layer of phosphor material deposited on its walls. When the faceplate is brought into intimate contact with the electrode-containing substrate, each such phosphor-coated well is designed to directly overlie a different one of the multiple intersections defined by the array of elongated X and Y electrodes. Electrical activation of a particular set of X and Y electrodes causes a gas contained between the faceplate and the substrate to be ionized locally at the intersection defined by the activation electrodes. In turn, the phosphor layer in the associated well is excited to provide a characteristic color.

In accordance with a feature of the invention, the longitudinally extending ridges that maintain the suspended electrodes above the substrate surface of the device serve as multiple internal support members when a faceplate containing phosphor wells is brought into intimate contacting relationship with the substrate. Additionally, the longitudinally extending ridges and wells combine to provide excellent optical isolation among the multiple closely packed phosphor regions of such a device.

BRIEF DESCRIPTION OF THE INVENTION

A complete understanding of the present invention and of the above and other features and advantages thereof may be gained from a consideration of the following detailed description presented hereinbelow in connection with the accompanying drawing, not drawn to scale, in which.

DETAILED DESCRIPTION

Figure 1:
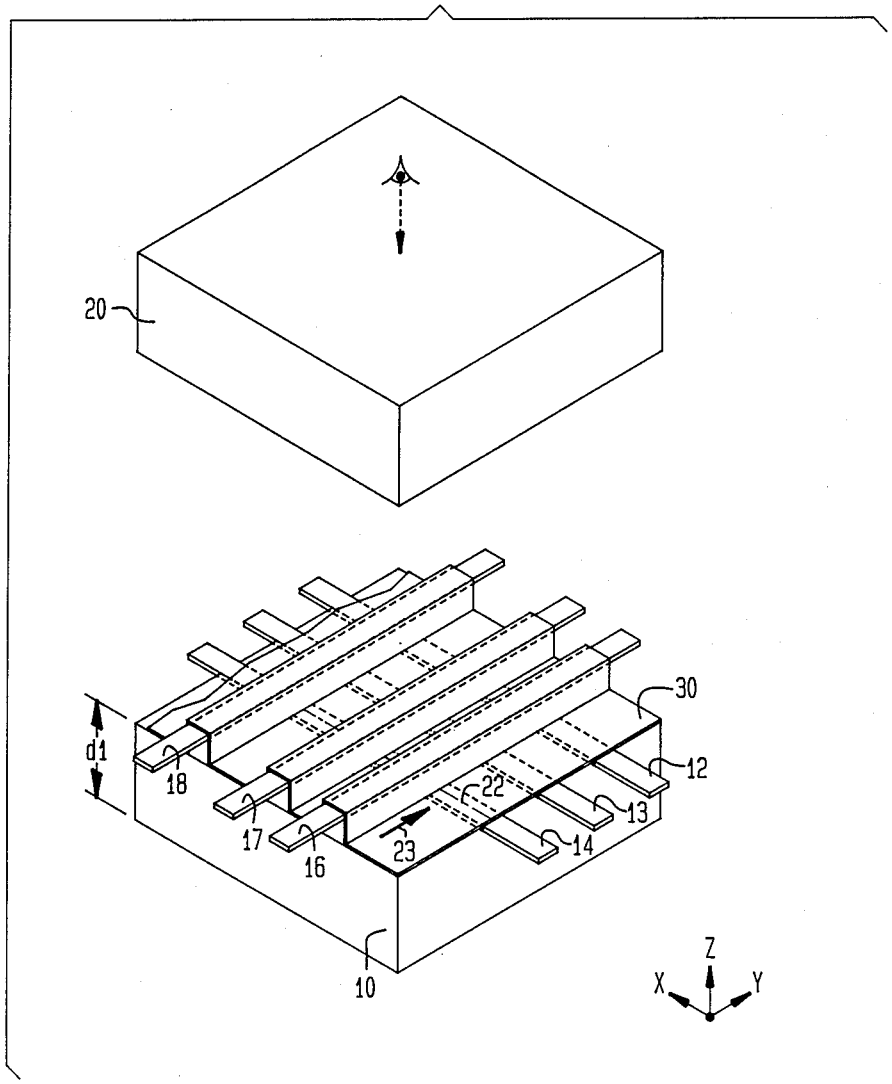
FIG. 1 is a representation of a portion of the faceplate and substrate of a specific illustrative plasma display device that embodies the principles of the present invention.

The simplified view of FIG. 1 illustrates the unique manner in which one specific illustrative embodiment of the present invention is structurally arranged. In practice, a display device made in accordance with the FIG. 1 representation would include multiple individual X-direction electrodes formed directly on the top surface of substrate 10 and multiple Y-direction pairs of sustain electrodes suspended above the surface of the substrate 10. So as not to unduly complicate the drawing, however, FIG. 1 explicitly depicts only three X-direction electrodes 12 through 14, one complete pair of Y-direction electrodes 16 and 17 and only one electrode 18 of an adjacent pair of Y-direction electrodes. As will be evident from the description later below, each intersection defined by an X-direction electrode and a different associated pair of Y-direction electrodes is designed to directly underlie a respective one of multiple spaced-apart phosphor regions on faceplate 20 when the substrate 10 and the faceplate 20 are brought together into sealed contact with each other to form a display device.

A standard ionizable gas (for example, a 1% xenon - 99% helium mixture) is introduced and contained within the internal spaces that exist in an assembly comprising the substrate 10 and faceplate 20 of FIG. 1. The introduction and peripheral containment of such a gas are done in conventional ways well known in the art. Thus, for example, standard peripheral seals (not shown) formed on the substrate 10 or on the faceplate 20, or on both, may be utilized to contain the introduced gas in the depicted device. The particular manner in which the gas flows internally within the sealed device will become apparent later below.

The faceplate 20 shown in FIG. 1 comprises a sheet of, for example, float glass which contains no electrodes thereon. Advantageously, the aforementioned phosphor regions comprise multiple spaced-apart phosphor-coated wells formed in the lower surface of the faceplate 20. The individual nature and arrangement of these wells will be specified later below.

The substrate 10 of FIG. 1 is made, for example, of soda-lime float glass which is a standard material utilized for plasma display devices. By way of example, the thickness d of the substrate 10 is approximately 2.5-to-3 millimeters (mm). The particular manner in which the substrate 10 is processed to form various layers and elements thereon, including the electrodes 12 through 14 and 16 and 18, will be described in detail later below.

Figure 2:
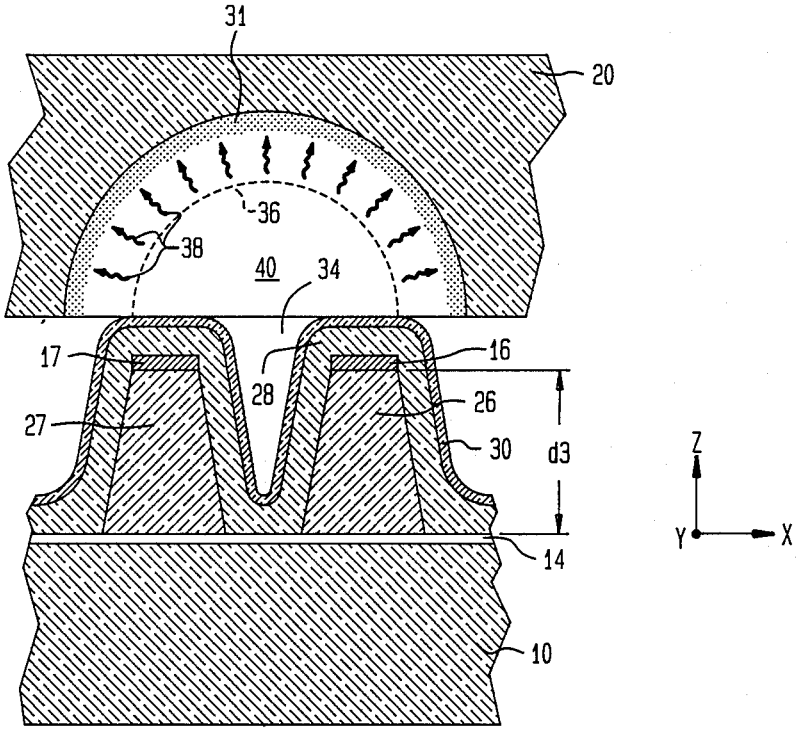
FIG. 2 is a cross-sectional front view showing one well region of the FIG. 1 embodiment overlying its respectively associated X-Y electrodes.

The particular nature of the FIG. 1 embodiment will become more apparent by consideration of FIG. 2. FIG. 2 is a cross-sectional front depiction of a portion of the overall device of FIG. 1 as viewed along line 22 in the direction of arrow 23.

FIG. 2 shows the X-direction electrode 14 of FIG. 1 formed directly on the top surface of the substrate 10. Further, the pair of Y-direction electrodes 16 and 17 of FIG. 1 are shown in FIG. 2 respectively supported by longitudinally extending Y-direction dielectric ridges 26 and 27. A dielectric layer 28 is deposited over the electrodes 14, 16 and 17 and the ridges 26 and 27. In turn, a layer 30 advantageously overlies the layer 28. The top-most layer 30 of the substrate assembly is made, for example, of magnesium oxide. The function of the layer 30 will be described later below.

By way of illustrative example, the phosphor region on the faceplate 20 of FIG. 2 that directly overlies the intersection defined by the electrodes 14, 16 and 17 comprises a layer 31 of standard phosphor deposited on the walls of a rounded-bottom well 40. The space 34 bounded by the walls of the well 40 and the layer 30 between the electrodes 16 and 17 contains a portion of the aforementioned ionizable gas. When, for example, activation pulses are applied between the bottom electrode 14 and one of the suspended electrodes 16 and 17, the gas in the indicated space is ionized. In practice, the actual gas discharge occurs approximately in the region below dash line 36. In turn, radiation from the discharge, indicated by arrows 38, excites the phosphor layer 31 to emit light of a characteristic color through the top of the transparent faceplate 20.

The region in the well 40 of FIG. 2 between dash line 36 and the phosphor layer 31 is essentially ion-free. This insures that the phosphor layer 31 receives a negligible amount of bombardment damage due to ions from the discharge in the space 34. In practice, this insures that the layer 31 will have a long-life characteristic.

Subsequent to ionization of the gas in the aforementioned region of FIG. 2, the pulses applied to the electrode 14 are discontinued but pulses continue to be applied to the pair of electrodes 16 and 17, thereby to sustain the discharge. To turn off the discharge, synchronized pulses are applied to the electrode 14 in exact opposition to those applied to the sustain electrodes.

The magnesium oxide layer 30 of FIG. 2 is characterized by a relatively high secondary-electron-emission property. This facilitates the discharge in the space 34. In particular, the layer 30 allows a specified concentration of ions to occur and to be sustained in the indicated space at a lower voltage than if the layer 30 were not included in the depicted structure. Also, the refractory layer 30 is effective to protect the dielectric layer 28 from damage due to ion bombardment from the discharge.

It is generally advantageous to deposit the phosphor layer 31 on the walls of rounded-bottom wells, as illustrated in FIG. 2, rather than on spaced-apart regions of the planar bottom surface of the faceplate 20. Such phosphor-coated wells expose a larger area of phosphor to excitation by a given discharge than do planar phosphor regions. Also, optical isolation among the phosphor-coated wells is inherently relatively high compared to a planar arrangement of phosphor regions. (In a planar arrangement, separate isolation barriers or other techniques must typically be resorted to to avoid optical cross-talk.)

Figure 3:
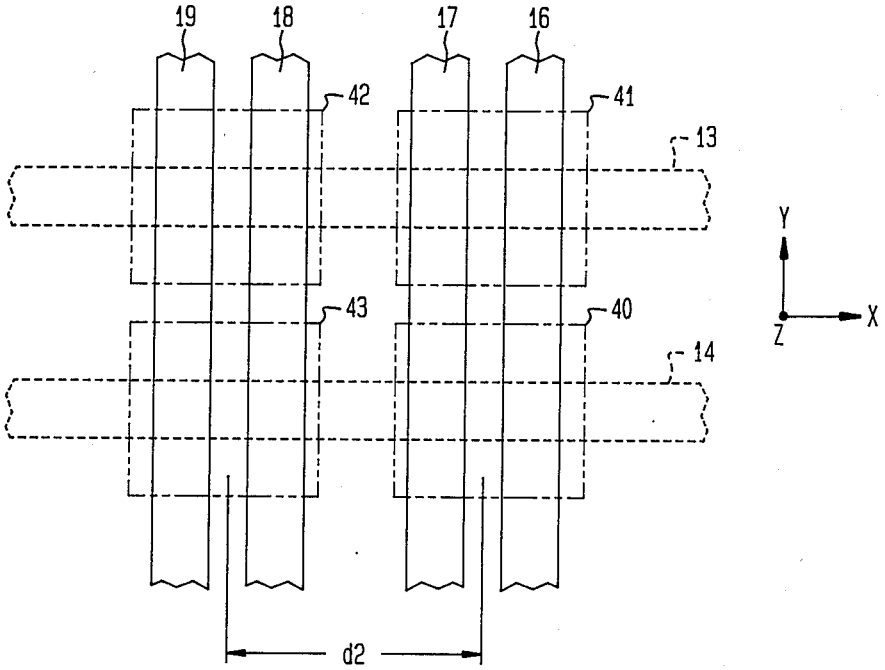
FIG. 3 is a simplified schematic top view of four well regions of the FIG. 1 embodiment.

FIG. 3 is a schematic Z-direction top view of a device of the type represented in FIGS. 1 and 2. In FIG. 3, X-direction electrodes 13 and 14 and Y-direction electrodes 16, 17 and 18 correspond to the identically numbered electrodes in FIGS. 1 and 2. An additional Y-direction sustain electrode 19 is also shown in FIG. 3.

Furthermore, dot-dash line 40 in FIG. 3 represents the faceplate well 40 of FIG. 2 that overlies the intersection of the electrodes 14, 16 and 17. Three other well regions respectively overlying intersections of the depicted electrodes are also indicated in FIG. 3. These other well regions are respectively designated therein by dot-dash lines 41 through 43.

Illustratively, for a full-color display device, the regular X-Y array of four phosphor-coated wells 40 through 43 (FIG. 3), each designed to emit a different characteristic color, may be considered to comprise a four-cell pixel. For monochromatic applications, each individual well of a multitude of identical wells may constitute a one-cell pixel. In one specific illustrative embodiment of the depicted display device, the center-to-center distance d2 of adjacent wells is only about 0.3 mm.

Figure 4:
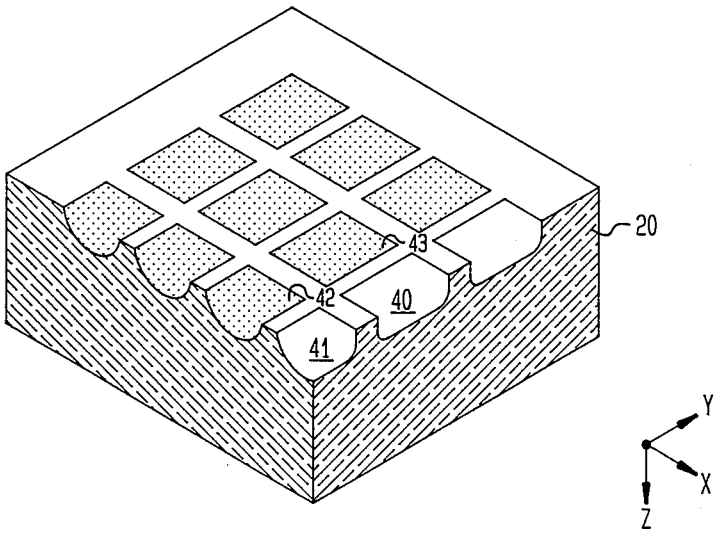
FIG. 4 depicts some of the phosphor-coated wells included in the faceplate of the FIG. 1 device.

FIG. 4 shows a portion of the underside of the faceplate 20 of FIGS. 1 and 2. The phosphor-coated wells 40 through 43 represented in FIGS. 2 and 3 are also shown in FIG. 4. Eight other wells of a multitude of wells constituting a regular orthogonal X-Y array of cells are also indicated in FIG. 4.

In accordance with the principles of the present invention, the substrate and faceplate of a display device are fabricated by photolithographic and other integrated-circuit fabrication techniques designed to provide high-resolution structural features. Thus, for example, the X-direction electrodes 12 through 14 shown in FIGS. 1 through 3 are made by initially depositing a 1-to-2 micrometer (μm)-thick conductive layer on the top surface of the substrate 10. Illustratively, this layer advantageously comprises a 1μm- thick film of copper sandwiched between two 1000-Angstrom unit (Å)-thick films of a standard nickel-iron alloy that contains approximately 5% chrome to insure good adhesion to the top surface of the substrate 10. Material selection for the conductive layer is made such that the constituent films can be subsequently etched in a single-step etching procedure.

Photopatterning and etching of the aforedescribed conductive layer are then carried out. Etching of the patterned layer is done, for example, in a ferric chloride solution. Illustratively, a dense array of elongated X-direction electrodes each having a width of only about 100 μm is thereby formed on the surface of the substrate 10. Typically electrodes made in this way exhibit sheet resistivities of better than 20 milliohms per square.

The substrate and the spaced-apart electrodes thereon are then overcoated with a layer of a conventional dielectric material. The thickness of this layer is chosen such that after the layer is reflow-fired, the resulting thickness of the dielectric will be approximately 50 μm. This thickness, which is shown as d3 in FIG. 2, determines the distance by which the subsequently formed Y-direction electrodes will be suspended above the surface of the substrate 10.

Next, a conductive layer is deposited on the entire top surface of the aforedescribed reflow-fired dielectric layer. Illustratively, this layer is identical to the previously described layer from which the X-direction electrodes were formed. Photopatterning and etching of this second-mentioned conductive layer are then carried out, utilizing, for example, the same procedure as described above. Illustratively, the resulting pairs of Y-direction electrodes are also each about 100 μm wide, but their density is typically approximately twice that of the X-direction electrodes represented in FIGS. 1 through 3.

Subsequently, using as a mask the photoresist strips that remain from the photopatterning step and that respectively overlie the paired X-direction electrodes, the 50-μm-thick dielectric layer is etched in, for example, fluoroboric acid. Etching is carried out until the surfaces of the underlying X-direction electrodes have been exposed. In that way, relatively narrow longitudinal Y-direction recesses are formed between the electrodes of each pair of electrodes. At the same time, relatively wide longitudinal Y-direction recesses are formed between adjacent pairs of electrodes. As a result, the Y-direction electrodes are respectively positioned on the tops of longitudinally extending dielectric ridges. Electrodes 16 and 17 in FIG. 2 suspended on ridges 26 and 27, respectively, are illustrative of one such pair of X-direction electrodes.

Both the narrow and wide recesses specified above provide the necessary channels in an assembled sealed device for evacuation and gas filling. Further, the narrow recesses between the electrodes of each pair of suspended electrodes are effective to considerably reduce the parasitic capacitances of the device. At the same time, the aforementioned ridges and the layers thereover serve as physical spacers to insure proper discharge in and large-area support of the device.

Next, in the fabrication sequence, the aforementioned photoresist strips are removed and the substrate structure is then coated with a substantially uniform 20-to-25-μm-thick (reflow-fired) layer 28 (FIG. 2) of a standard dielectric material. The properties of this material are chosen to insure excellent dimensional integrity and dielectric quality of the depicted structure.

The aforementioned layer 30 (FIG. 2), made, for example, of magnesium oxide, is then deposited on the dielectric layer 28. Illustratively, the layer 30 is formed by electron-beam evaporation and is designed to have a thickness of about 4000 A.

By way of example, the wells shown in FIG. 4 are approximately square in cross-section at the surface of the faceplate 20. During the course of photopatterning and etching the faceplate to form a dense pattern of microminiature wells, the bottoms of the wells are typically advantageously rounded. One such specific illustrative rounded-bottom well 40 is shown in FIG. 2. Each such well includes a standard phosphor deposited on the walls thereof, as indicated in FIGS. 2 and 4.

Figure 5:
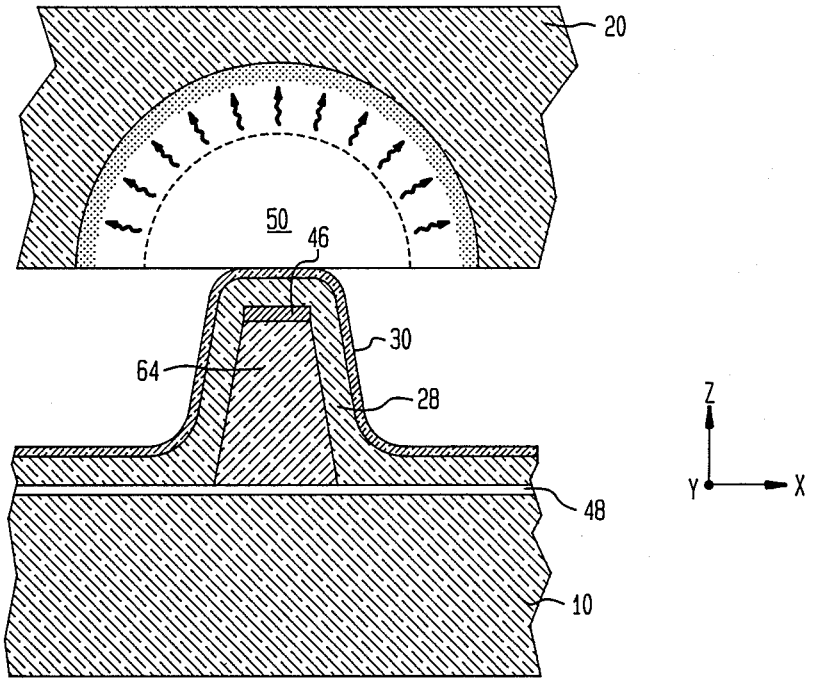
FIG. 5 is a cross-sectional front view of one well region of another specific illustrative display device that embodies the principles of the present invention.

Another specific illustrative embodiment of the previous invention is represented in FIG. 5. As in the above first-described embodiment, the FIG. 5 device also includes a substrate 10 and a faceplate 20. Other elements in FIG. 5 that correspond to elements in the previously described embodiment are identified by the same reference numerals. Further, phosphor-coated well 50 of FIG. 5 may be identical to the previously described wells. But in the FIG. 5 device, the well 50 directly overlies an intersection defined by a single suspended Y-direction electrode 46 and a pair of X-direction electrodes on the surface of the substate 10. One of these X-direction or sustain electrodes, identified by reference numeral 48, is shown in FIG. 5.

Figure 7:
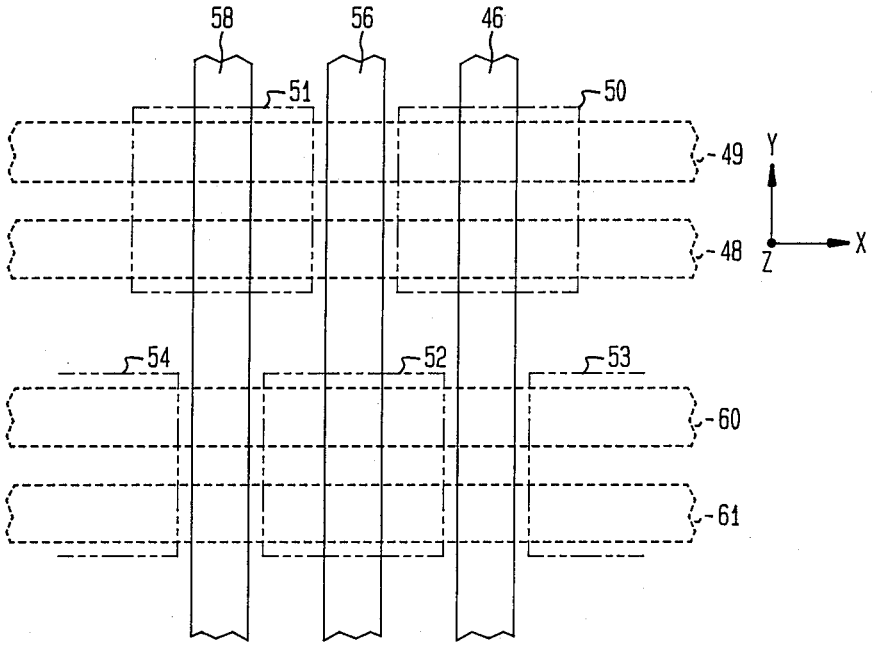
FIG. 7 is a simplified schematic top view that shows the well regions and associated X-Y electrodes of the FIG. 5 embodiment.

The relationship between the well 50 of FIG. 5 and the underlying X- and Y-direction electrodes is seen more clearly in FIG. 7. In FIG. 7, the well 50 is represented by dot-dash line 50 and the other X-direction electrode that is paired with the electrode 48 is designated by reference numeral 49. Two other Y-direction electrodes 56 and 58 and one other pair of X-direction electrodes 60 and 61 are also depicted in FIG. 7. Further, two other full wells 51 and 52 and portions of two additional wells 53 and 54 are outlined in FIG. 7.

In the embodiment represented by FIG. 7, each pixel advantageously includes three wells. The wells 50 through 52 constitute one such pixel. Illustratively, each of the wells 50 through 52 is coated with a phosphor of a different primary color. In that way, the depicted device is capable of a full-color display.

Figure 8:
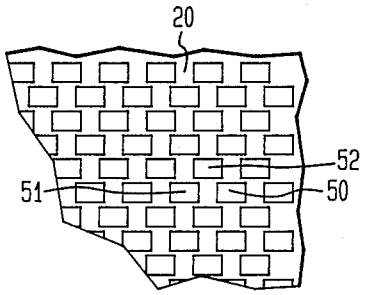
FIG. 8 schematically depicts the layout of some of the phosphor-coated wells included in the faceplate of the embodiment represented in FIG. 5.

FIG. 8 shows a portion of the underside of the faceplate 20 included in the embodiment represented by FIGS. 5 and 7. The three wells 50 through 52 of the particular pixel represented in FIG. 7 are shown in FIG. 8, as are multiple other sets of three wells each representative of a different full-color pixel. The depicted wells are arranged in a staggered orthogonal array.

In the device shown in FIGS. 5 and 7, the Y-direction electrode 46 is supported on a longitudinally extending dielectric ridge 64. As in the first-described embodiment, the Z-direction height of the ridge 64 is, for example, about 50 μm. The capacitance between the suspended electrode 46 and the associated pair of sustain electrodes therebelow is therefore relatively low.

Figure 6:
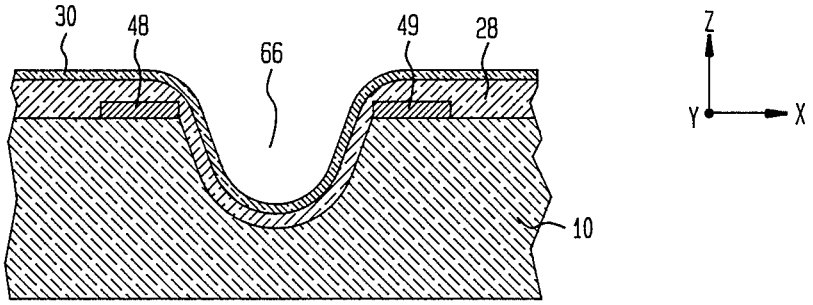
FIG. 6 is a cross-sectional showing of one pair of sustain electrodes included on the substrate of the FIG. 5 embodiment.

Moreover, in accordance with the principles of the present invention, a longitudinally extending X-direction trench is formed in the substrate 10 between the electrodes of each pair of sustain electrodes of the embodiment shown in FIGS. 5 and 7. One such trench 66, formed between the pair of sustain electrodes 48 and 49, is shown in FIG. 6. Illustratively, the trench 66 is formed by using the electrodes 48 and 49 as a mask during etching of the substrate.

Also shown in FIG. 6 are the dielectic layer 28 and the magnesium oxide layer 30 depicted in FIG. 5. In a sealed device, the space overlying the layer 30 along the X-direction trench 66 is filled with an ionizable gas.

The trench 66 between the pair of sustain electrodes 48 and 49 shown in FIG. 6 is designed to provide a relatively long path between these electrodes through the relatively high-dielectric-constant materials of the substrate 10 and the layer 28. As a result, the capacitance between the electrodes of each pair of sustain electrodes on the surface of the substrate 10 is relatively low.

By way of example, the fabrication sequence and the mode of operation of the display device represented by FIGS. 5 through 8 are similar to those of the earlier-described first embodiment. Illustratively, the phosphor in a selected well of the second-described embodiment is caused to emit light of a characteristic color by activating the Y-direction electrode and one of the X-direction electrodes whose respective intersection lies below the selected well. After locally ionizing the gas in the vicinity of the selected well, the gas discharge is sustained by continuing to apply pulses only to the associated pair of X-direction electrodes.

A unique advantage of the device embodiment depicted in FIGS. 5 through 7 is that independent electrical brightness control of the three individual color phosphors included in each pixel is possible. Thus, for example, assume that only the brightness of the phosphor in the well 50 of FIG. 7 is to be increased. Illustratively, this is done by applying additional sustain pulses to the electrodes 48 and 49 during each basic cycle of operation of the device. This will cause an enhanced excitation and hence greater-than-normal brightness of the light emitted by the already excited phosphor in the well 50. At the same time, if it is not desired to enhance the brightness of already excited phosphor in the well 51, which would also tend to be affected by the additional pulses applied to the sustain electrodes 48 and 49, synchronously occurring counteracting pulses are applied to the Y-direction electrode 58 to negate exactly the enhancing effect of the additional sustain pulses on the phosphor-coated well 51. Similarly, any other already activated wells coupled to the sustain electrodes 48 and 49 can be electrically controlled to be allowed to brighten or not in response to additional sustain pulses by not applying or applying, respectively, counteracting pulses to their respectively associated Y-direction electrodes.

Finally, it is to be understood that the above-described structures and processing techniques are only illustrative of the principles of the present invention. In accordance with these principles, numerous modifications and alternatives may be devised by those skilled in the art without departing from the spirit and scope of the invention. Thus, for example, it is emphasized that the particular well geometry described above and shown in the drawing is illustrative only. Other well geometrics are practicable. And, although wells or cavities in the faceplate are generally advantageous for the reasons specified above, it is feasible as noted earlier to deposit the phosphor directly on spaced-apart planar regions of the faceplate, provided that suitable optical isolation barriers are provided therebetween. Also, it is further emphasized that specific functions such as sustaining and addressing that were illustratively attributed above to particular electrodes in the described embodiments can if desired be switched among the electrodes associated with each phosphor region to minimize operating power.

What is claimed is:

1. A display device comprising:
a substrate including
a first set of spaced-apart longitudinally extending electrodes on the surface of said substrate,
spaced-apart longitudinally extending dielectric ridges overlying said electrodes and said substrate surface and disposed orthogonally with respect to said first set of electrodes to form longitudinally extending trenches between said ridges,
a second set of spaced-apart longitudinally extending electrodes each positioned on a different one of said ridges,
a dielectric layer overlying said substrate surface, said first and second set of electrodes and said ridges to only partially fill said trenches, said partially filled trenches providing distribution channels into which an ionizable gas may be introduced,
and a faceplate sealed to said substrate, said faceplate having spaced-apart phosphor regions respectively overlying intersections defined by said first and second sets of electrodes on said substrate.

2. A device as in claim 1 wherein each of said intersections is defined by a pair of said second set of electrodes and one of said first set of electrodes, each of said pairs constituting electrodes for respectively overlying phosphor regions.

3. A device as in claim 2 wherein said phosphor regions each comprise a layer of phosphor coated on the walls of a well formed in said faceplate.

4. A device as in claim 3 wherein said phosphor-coated wells are arranged in a regular orthogonal array.

5. A device as in claim 4 wherein a refractory layer characterized by a relatively high secondary-electron-emission property overlies said dielectric layer, and wherein the surface of said faceplate in which said wells are formed rests in contact with portions of said refractory layer that directly overlie said second set of electrodes, 6. A device as in claim 5 wherein each of said phosphor-coated wells includes a rounded bottom.

7. A device as in claim 6 wherein said refractory layer comprises magnesium oxide.

8. A device as in claim 1 wherein each of said intersections is defined by a pair of said first set of electrodes and one of said second set of electrodes, each of said pairs constituting electrodes for respectively overlying phosphor regions.

9. A device as in claim 8 wherein a longitudinally extending trench is formed in said substrate between the electrodes of each pair of electrodes of said first set.

10. A device as in claim 9 wherein said phosphor regions each comprise a layer of phosphor coated on the walls of a well formed in said faceplate.

11. A device as in claim 10 wherein said phosphor-coated wells are arranged in a staggered orthogonal array.

12. A device as in claim 11 wherein a refractory layer characterized by a relatively high secondary-electron-emission property overlies said dielectric layer, and wherein the surface of said faceplate in which said wells are formed rests in contact with portions of said refractory layer that directly overlie said second set of electrodes.

13. A device as in claim 12 wherein each of said phosphor-coated wells includes a rounded bottom.

14. A device as in claim 13 wherein said refractory layer comprises magnesium oxide.

* * * * *

UNITED STATES PATENT AND TRADEMARK OFFICE

CERTIFICATE OF CORRECTION

PATENT NO. : 4,853,590

DATED : August 1, 1989

INVENTOR(S) : Nicholas C. Andreadakis and Peter D. T. Ngo

It is certified that error appears in the above-identified patent and that said Letters Patent is hereby corrected as shown below:

On the title page, under item [19],
change "Andreadakis" to --Andreadakis et al.--;

item [75], change "Inventor" to --Inventors-- and add --Peter D. T. Ngo, Colts Neck, Monmouth County, N. J.--.

Signed and Sealed this

Twenty-fourth Day of July, 1990

*Attest:*

HARRY F. MANBECK, JR.

*Attesting Officer*

*Commissioner of Patents and Trademarks*